United States Patent [19]

Otey, III et al.

[11] 4,180,337

[45] Dec. 25, 1979

[54] KEYBOARD ARRANGEMENT

[76] Inventors: Flem B. Otey, III; Yoshiko S. Otey, both of 2230 Morena St., Nashville, Tenn. 37208

[21] Appl. No.: 845,586

[22] Filed: Oct. 26, 1977

Related U.S. Application Data

[63] Continuation-in-part of Ser. No. 667,871, Mar. 17, 1976, abandoned, which is a continuation-in-part of Ser. No. 485,914, Jul. 5, 1974, abandoned.

[51] Int. Cl.[2] ..... B41J 5/10

[52] U.S. Cl. ..... 400/486; 283/11

[58] Field of Search ..... 400/483, 486, 487; 35/5, 6, 14; 235/145 R; 283/11, 17; 340/365 R, 365 S

[56] References Cited

U.S. PATENT DOCUMENTS

| | | | |
|---|---|---|---|
| Re. 79 | 1/1846 | Morse | 35/14 X |
| 79,868 | 7/1868 | Sholes et al. | 400/472 X |
| 1,823,130 | 9/1931 | Smith | 400/483 |
| 3,927,752 | 12/1975 | Jones et al. | 400/487 |

FOREIGN PATENT DOCUMENTS

| | | | |
|---|---|---|---|
| 194331 | 1/1908 | Fed. Rep. of Germany | 400/486 |
| 2614685 | 10/1976 | Fed. Rep. of Germany | 400/486 |

*Primary Examiner*—Paul T. Sewell

[57] ABSTRACT

An arrangement of keys on a keyboard in which each letter of the alphabet is represented by an individual key, with the keys being arranged in five primary rows. Each primary row begins with a vowel-representing key, which keys are arranged in alphabetical order along one edge or side of the keyboard. Each vowel-representing key is followed by certain consonant-representing keys in alphabetical order. The center row of the arrangement begins with the vowel i and is followed by j, k, l, m and n.

1 Claim, 3 Drawing Figures

KEYBOARD ARRANGEMENT

CROSS-REFERENCE TO RELATED APPLICATIONS

This is a continuation-in-part application of Ser. No. 667,871, filed Mar. 17, 1976, which is a continuation-in-part application of Ser. No. 485,914, filed July 5, 1974, both abandoned.

BACKGROUND OF THE INVENTION

The present invention relates to a unique, easy to use, alphabetical keyboard. It is useful in the miniature, electronic translating device disclosed in the above parent applications, though the invention is not limited thereto. The invention involves a logical arrangement of keys heretofore unavailable in keypunch machines, typewriters, pocket calculators and the like.

There are presently available many hand-held keyboard terminals for instructing computers, such keyboard terminals being connected to the computers through cables adapted to carry signals from the keyboard to the computers. In addition, there are many compact computing devices and calculators that are wholly integrated and portable for carrying about in one's pocket or briefcase. These devices generally can also be held in one hand and operated by pressing appropriate keys of a keyboard of the devices using the fingers of only one hand. However, these devices are limited to making numerical and mathematical calculations only. If it is desired to communicate with words, using mechanical or electronic devices having all twenty-six letters of the alphabet, keypunch machines and typewriters are available that employ well-known key arrangements that are not conveniently usable by a single hand or easily and quickly learned by the non-typist. However, in U.S. Pat. Nos. 3,925,779 and 3,932,859 respectively to Gerstenhaber and Kyriakides et al, an arrangement of keys is shown for compact electronic devices that appear operable by a single human hand. In the Kyriakides et al patent, the vowel and consonant keys are arranged in the manner of typewriter keys, while in the Gerstenhaber device, letter keys are not used at all; rather the keys are used in "coded" manner in which whole words or phrases can be ordered by the punching of one key.

A keyboard showing the numerical order of telephone push button arrangements is shown in U.S. Pat. No. 3,757,037 to Bialek, such arrangements using ten keys for numerals zero to nine.

A typewriter keyboard arrangement for Japanese katakana characters, and use by both hands of a typist, is shown in U.S. Pat. No. 1,687,939 to Jones, the arrangement locating vowel sounds of the syllabic characters in an orderly fashion so that the same vowel in any of the syllabic characters is found in about the same position in a key row.

A keyboard arrangement showing alphabetical order of letter keys (for telegraphic use) is shown in an old U.S. Pat. No. 12,929 to White. However, the five vowel keys are not arranged in an orderly fashion, the o being surrounded by k, n, s and p in an intermediate row of the arrangement. Similarly, u is located between q and y in the upper row of the arrangement. The importance of vowels resides in the fact that they are common to all Western peoples, that they can be recognized by such peoples when communicating with each other in attempts to break through language barriers. Thus, an orderly arrangement of vowels is important in any letter keyboard designed to provide a full range of words for communication purposes.

BRIEF SUMMARY OF THE INVENTION

The present invention is directed to a keyboard arrangement in which certain "home" keys of a keyboard are strategically located so that all remaining keys are located within two steps of the home keys, and the relationship of all the keys is quickly learned by the lay person. This is accomplished by having each key of a keyboard represent a single letter of the alphabet, and arranging the keys in five primary rows, with each row beginning with a respective one of the five vowel letters, the vowel-representing keys being arranged in alphabetical order along one edge of the keyboard. Each vowel key is followed by certain consonant keys in alphabetical order, with the center i row having j, k, l, m and n keys following the i. In this manner, the a and e rows and the o and u rows, with their following consonant keys, are all within two steps of the i row, and within the i, j, k and l keys, when these keys are considered the home keys.

Since all Romance languages employ the five vowel sounds in a manner very similar to the English language, the keyboard of the invention is quickly learned by any literate person in the Western World, and is particularly useful in the compact translating device disclosed in the above-cited parent applications, and with a logical dot-dash code discussed hereinafter. In addition, because of the arrangement of the keys, i.e., because of their quick assimilation in the mind of the user, the keyboard of the invention can be easily operated by the thumb, if the device of the keyboard is held between the thumb and four fingers of the human hand, or by the four fingers of either hand when held by the other, or if the device is resting on a stable surface.

The invention includes further an arrangement in which the alphabetical keys are also employed to represent numerals and certain mathematical operations, the arrangement locating numeral one (1) on the i key, and zero (0) on the o key, the numbers being, similarly, in easy-to-find, numerical sequence. At least two additional keys are provided, with the keys representing both letter and number designations, to allow selection between the two modes (alphabetical or numerical) of operation.

BRIEF DESCRIPTION OF THE DRAWINGS

The objectives and advantages of the invention will best be understood from the following detailed description and the accompanying drawings, in which FIGS. 1, 2 and 3 show respectively three embodiments of the invention.

PREFERRED EMBODIMENTS

Figure 1:
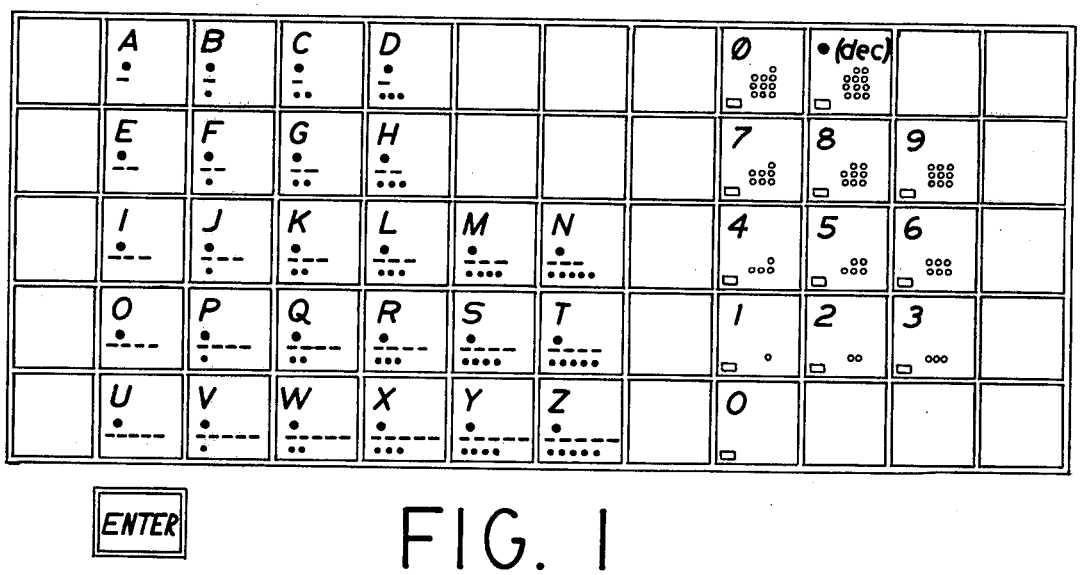

Referring now to FIG. 1 of the drawing, a keyboard of twenty-six letter keys is shown, the letters of the keys being the English alphabet. The letters are arranged in five primary, horizontal rows, as shown in FIG. 1, with each primary row beginning with a vowel key, the vowel keys being in alphabetical, descending order on the left-hand side of the keyboard. The first two rows begin respectively with a and e, with each followed by three consonants in alphabetical order. The i row, which is the center row of keyboard 10, contains five consonants j, k, l, m and n in alphabetical order. Similarly, the next row is the o row, the o being followed alphabetically by consonants p, q, r, s and t, while the u row contains v, w, x, y and z, in that order. Thus, keyboard is completely in alphabetical order and all primary rows begin with vowel sounds, in alphabetical order. All Western persons will recognize the order and thereby quickly grasp the system of the arrangement. There is no necessity to hunt for the vowel keys. Whether deaf, dumb, blind or quadraplegic almost any literate person can "instantly" use this keyboard because of the "logical" arrangement. The "hunt and peck" system or time consuming memorization of a "touch" system of typing is unnecessary with the keyboard of the present invention.

Moreover when connected to a silent printer or tape recorder a student, for example, could type papers or notes in a library (holding the book and turning pages with one hand while typing with the other), or take legible notes in class by quietly keying into a tape recorder then playing back the tape into a printer or IBM Selectric automatic typewriter. The advantage here is that an ordinary person can type verbatim with one hand, without any special training or the use of two hands.

Figure 2:
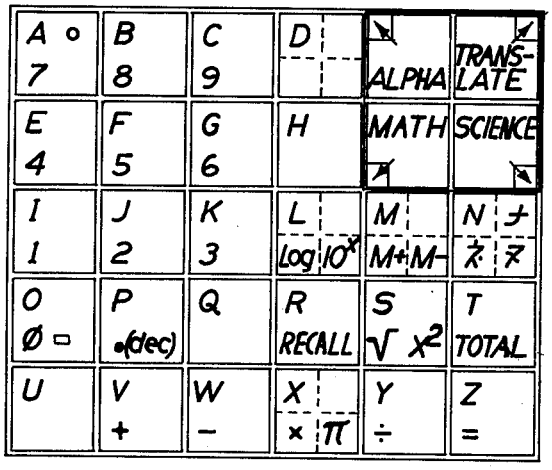

Further, the logical pattern of the keyboard of FIGS. 1 and 2 eliminates the need to learn the esoteric Morse or ASC II Codes, such codes preventing masses of amateurs and laypersons from communicating digitally. Instant familiarity with this keyboard arrangement also makes the code shown in FIG. 1 a universal code, as described hereinafter, because it is adaptable to all Romance, phonetic or alphabetic languages.

The above order of the primary, horizontal rows can also be reversed, so that the A row is at the bottom of the keyboard, and the U row is the uppermost row, as shown in FIG. 3.

In addition, it will be noted that in the arrangement of the invention, the i row of letters is in the center of the keyboard so that if the four fingers (index to small finger) of either hand are placed respectively on the i, j, k and l, all other letter keys are within two steps of these four letters. In this manner, the four fingers of a single hand of the user can easily and quickly travel to the key locations to operate all twenty-six letter keys, thereby providing complete, intelligible messages when the keys operate an appropriate device or machine (not shown) capable of receiving the message of the keys punched or pushed, and reproducing the message in visible form. The other hand of the user is not needed, except to hold the device of the keyboard if a surface is not available for the device. Similarly, the device can simultaneously be held in, and the keys of arrangement in FIG. 1 operated by the thumb of, a single hand, in the manner of commercially available pocket calculators.

In the keyboard of FIG. 1, number-representing keys are provided but are located separately from the letter keys. The number keys are in numerical order so that their order is quickly assimilated for use by the user of the keyboard. Further, additional keys are shown on the keyboard of FIG. 1 for extra functions, such as translation, synonym and other uses, such as described in the above parent applications.

In the embodiment shown in FIG. 2, the numbers (of FIG. 1) are combined with letters so that keys now serve a double function. A choice between the two functions is provided by mode selection keys, as indicated by the keys bearing the words "alpha" (for alphabetic use of the keyboard and associated device), and "math" for mathematical and numerical use of the keyboard and device. The key arrangement of FIG. 2 is simplified by locating numeral one (1) on the letter key i, and zero (0) on letter key o. From zero, the numbers follow the letter keys in an ascending order of three rows and in numerical order. The user of keyboard of FIG. 2 has the same ease as in FIG. 1, while simultaneously providing a keyboard that is more compact than that of FIG. 1.

In addition to the number and letter keys shown in FIG. 2, mathematical function keys are easily added, as shown, and used with well-known circuit chips to perform mathematical functions, still only using a maximum of only 30 keys, in the manner shown in FIG. 2. For this reason, the keyboard of FIG. 2 is particularly versatile and compact.

In addition to the above ease of operation provided by the keyboard of the invention, the keyboard also permits the use of a simple easy-to-learn code using the dot-dash sequence shown in FIG. 1. As will be noted in FIG. 1 of the drawing, each letter and number key of the keyboard is provided with a dot-dash combination so that the user of the keyboard can quickly sight the code and use the code associated with each letter and number. For the blind person, the letters and code on each key can be raised or indented so that they can be quickly felt through the fingertips, and, if the blind person can hear, an electronic oscillator provided within the device of the keyboard can be used to provide an audible tone to signify each dot and dash and each space or pause therebetween. For example, using the ENTER key shown in FIG. 1 to energize the oscillator, a one second long signal can be an audible dot, a two second signal can be an audible dash, while a three second space or silence would signify the end of the letter or word. A three second audible signal or tone could be used to indicate an erasure of the previous entry.

In addition, in using the code of FIG. 1, the use of a single dot tone initially means that alphabetic letters will follow. Similarly, the use of a single dash signal means initially that numbers will follow.

It will be noted in FIG. 1 that dashes follow (i.e. are below) the dots and are in numerical order in proceeding down the keyboard, i.e., A is a dot-dash, E is a dot-dash-dash, and so forth, with U ending with a dot and five dashes. As further seen in FIG. 1, further dots located below the vowel dashes are the subsequent consonants following sequentially the preceding dash, i.e., the B-dash is above a single dot, while C and d use two and three dots, respectively, below each (A) dash.

Thus, it is seen that the first row of the keyboard is very simple with the B, C and D being designated by a sequential number of dots located below each "A" dash. Similarly, the E row, having two dashes for each letter in that row, is above a dot code, the number of dots being in sequential, increasing order. The I row, as seen in FIG. 1, has three dashes, the O row has four dashes, and the U row has five dashes, all of the letters following the vowels having an increasing number of dots below the dashes to signify respective consonants.

As noted in FIG. 1 of the drawing, the zero key is also denoted by a dash. All other numerical keys thereafter start with a dash and are followed by dots in a logical, sequential and numerical order. The dots, however, are in no more than groups of two or three, the user of the keyboard using a slight delay between the groups of dots. Thus, the number 5, for example, is a dash (to indicate a number sequence) followed by three dots, a slight pause, and two dots, using the ENTER key of the keyboard to energize a sound oscillator. In addition, with appropriate circuitry, pressing the numbered or lettered key directly can also trigger the correct number of dots and dashes from an oscillator; hence, a faster and automated transmission of a message is possible with the keyboard of the invention.

Because of the numerical order of the code, the keyboard of FIG. 1 has two zeroes, the lower zero being located where a zero is normally expected. However, the code requires zero to be designated by ten dots. Thus the upper zero is at the top of the keyboard, above and to the left of nine. Eleven dots are used to signify a decimal.

As can be seen from the drawing, the numbers, like the letters, are easily learned to use the keyboard in the manner of a Morse Code, with the exception, of course, that the code of the keyboard of the invention is much simpler and logical, requiring no memorization of a peculiar, nonlogical set of dots and dashes.

In FIG. 2, the keyboard of the invention provides the same code facility except that the o and zero keys are combined with a dash key next to the zero (to indicate, again, numerical sequence) and the A and 7 key includes also a dot key located next to the A to indicate the alphabetic sequence for the user of the code and keyboard.

The keyboards of the invention therefore provide a unique, orderly use of a simple, logical code, as described above, and as provided by no other keyboard known to us.

While the invention has been described in terms of preferred embodiments, the claims appended hereto are intended to encompass all embodiments which fall within the spirit of the invention.

We claim:

1. A keyboard arrangement comprising a keyboard in which each letter of the alphabet of a language is represented by an individual key, the keys being arranged in five primary columns or rows, with each primary row beginning with a vowel-representing key, and followed by consonant-representing keys in alphabetical order, the vowel-representing keys being arranged in alphabetical order in a column along one edge or side of the keyboard, a portion of the alphabet-representing keys being respectively employed to also represent numerals in a manner that locates zero on the o key and numeral one on the i key, the numeral keys zero, one, four and seven being in numerical order in the vowel column of keys, with the remaining number-representing keys following the one, four and seven in numerical order.

* * * * *